United States Patent [19]

Muir et al.

[11] Patent Number: 5,046,886

[45] Date of Patent: Sep. 10, 1991

[54] UNIVERSAL STACKABLE MANHOLE SHIELD

[75] Inventors: David J. Muir, Farmington Hills; James J. Mason, New Hudson, both of Mich.

[73] Assignee: Marketing Displays, Inc., Farmington Hills, Mich.

[21] Appl. No.: 542,954

[22] Filed: Jun. 25, 1990

[51] Int. Cl.[5] ..... E02D 29/14

[52] U.S. Cl. ..... 404/25; 52/20; 49/477

[58] Field of Search ..... 404/25, 26; 220/287, 220/23.86; 49/463, 466, 477; 52/19, 20, 21

[56] References Cited

U.S. PATENT DOCUMENTS

| | | | |
|---|---|---|---|
| 2,431,082 | 11/1947 | Sayles | 404/26 |
| 2,559,564 | 7/1951 | Sperling | 220/232 |
| 2,593,918 | 4/1952 | Redman | 404/26 |
| 3,142,234 | 7/1964 | Maloon | 52/19 |
| 3,294,000 | 12/1966 | Pelsue | 404/25 X |
| 3,349,950 | 10/1967 | Wanderer | 220/287 X |
| 4,029,425 | 6/1977 | Pelsue | 404/25 |
| 4,188,151 | 2/1980 | Hall | 404/26 |
| 4,640,434 | 2/1987 | Johnsen et al. | 220/287 |

FOREIGN PATENT DOCUMENTS

| | | | |
|---|---|---|---|
| 1002017 | 2/1957 | Fed. Rep. of Germany | 404/25 |
| 7252 | of 1911 | United Kingdom | 404/25 |
| 1238 | of 1915 | United Kingdom | 404/25 |
| 211012 | 2/1924 | United Kingdom | 220/287 |
| 2145444 | 3/1985 | United Kingdom | 404/26 |

*Primary Examiner*—Stephen J. Novosad

*Attorney, Agent, or Firm*—Brooks & Kushman

[57] ABSTRACT

An improved extension shield for a manhole is disclosed. The shield seals around an open manhole frame protecting the instruments and men working inside from rain, snow, surface water and other elements. The shield is adapted to be installed in four differently sized openings and is constructed to preferably seal inside the lip of the manhole frame rather than on top of the lip. The shield is made of a durable molded plastic material and is stackable to create higher shields or for storage.

36 Claims, 2 Drawing Sheets

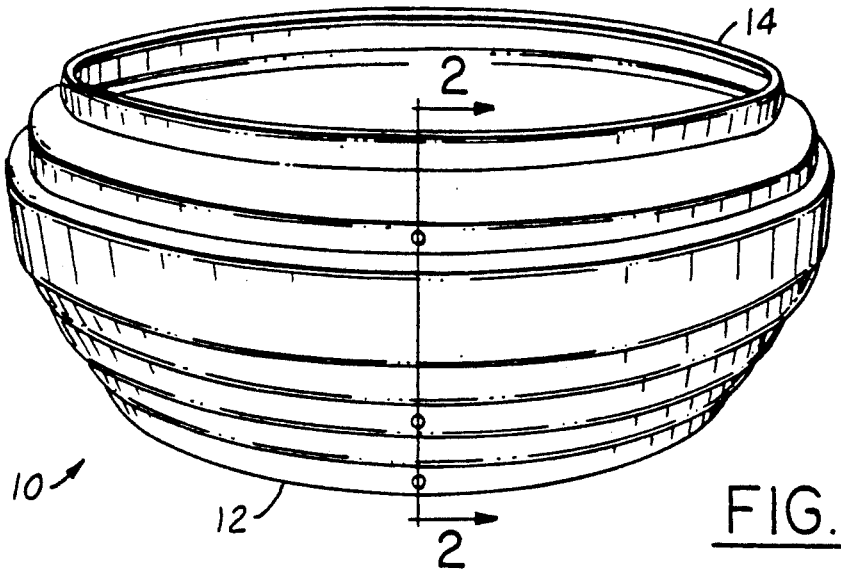
FIG. 1
FIG. 2
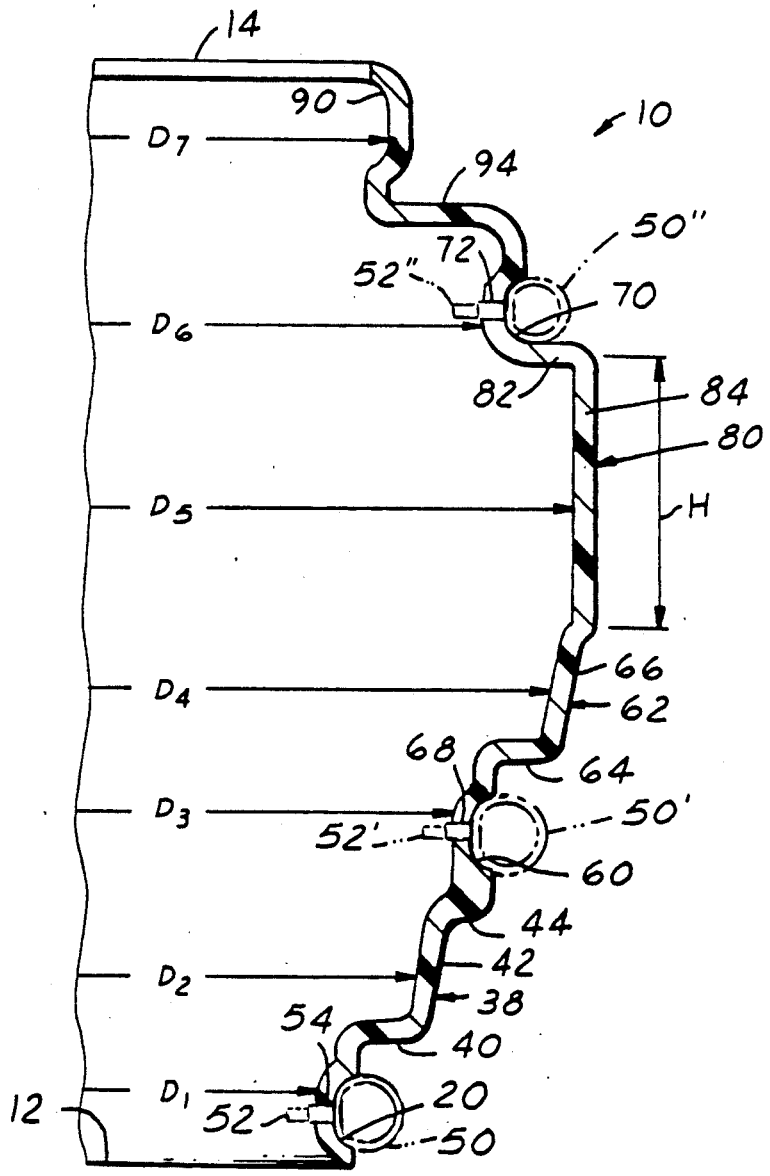

UNIVERSAL STACKABLE MANHOLE SHIELD

BACKGROUND OF THE INVENTION

The present invention relates to an improved manhole shield which is adapted to be supported on a manhole frame when the manhole cover is removed and act as a barrier to prevent water, dirt, tools and other materials from flowing or falling into the open manhole.

It has been known in the past to position shields around open manholes. When a manhole cover for a manhole that opens into an underground passageway, or an underground service chamber for servicing or repairing electrical, gas or water conduits and the like is removed, it is customary to position a shield or barrier around the frame opening to prevent tools, surface water and foreign material from falling into the opening and onto the workmen below the opening. It is also important to protect the utility conduits, switches, wires and instruments which may be exposed by the open manhole from the surface elements. Serious discomfort (and possible injury) to the workmen and serious damage to the facilities can occur if water or debris are allowed to enter the open manhole.

Manholes typically comprise circular access openings defined by heavy metal rings fastened to the top of standpipes. The rings are mounted flush with the surrounding road or ground surface and are relatively permanently attached to the adjoining street, roadway or other surface covering. In general, an annular recessed groove is provided around the inside top surface of the ring and a heavy metal lid (a/k/a "manhole cover") is positioned in the groove covering the opening.

In the past, shields or barriers were made generally corresponding to the diameter of the opening and were positioned around the opening or in the manhole cover recessed groove. Initially, these devices were caulked or packed in some manner in an attempt to prevent water from entering the opening. Not only was this time consuming and expensive, but often the caulking or packing did not seal the opening sufficiently. Other problems related to the fact that the frame rings often had significant dimensional variations and many were provided in different sizes. Rings which varied widely in diameter and which were not truly circular in shape were difficult to seal.

Some attempts have been made to solve some of these problems and provide better and more versatile open manhole shields or barriers. These are shown, for example, in U.S. Pat. Nos. 3,294,000 and 4,029,425 which disclose the use of a one-piece shield which relies on an inflatable gasket to seal the opening in the cover recess. The shields shown in these patents still are limited in their ability to seal openings of varied diameters, to provide positive seals, and to create stable shields.

It is thus the main object of the present invention to provide a manhole opening shield which is an improvement over known shields.

It is another object to provide a manhole shield which provides a more positive seal, is able to be used in more openings of varied diameters, and is stable once it is set in position than known shields.

It is a still further object of the invention to provide a shield which is light in weight, durable, convenient and easy to use, and which stacks for storage and/or to provide a higher shield when necessary.

These and other objects will be apparent from the following drawings and description of the invention.

DISCLOSURE OF THE INVENTION

The present invention is a manhole shield adapted to be inserted in open manhole openings and seal them from dirt, water and other debris. The shield is a one-piece member preferably molded of a durable plastic material. The member has a series of annular grooves and shapes around its periphery corresponding in diameter to the different sizes of four standard manhole frame rings. An inflatable inner tube is positioned in the groove selected to fit the opening and after the member is put into position, the tube is inflated to create a seal between the member and the frame ring.

Due to the shape of the member, the sealing tube fits and sits inside (below) the lip of the manhole frame creating a clean tight lock, rather than on top of the lip where debris accumulates and it could be easily dislodged. Annular surfaces and shoulders on the member are adapted to seat in the manhole cover recess to prevent tipping and make the shield more stable.

The inventive shield has a stacking ring or means along one end or edge to allow two or more shields be stacked on top of one another to create a higher barrier or for transport and storage. When used as a higher barrier, stacked shields can be sealed and held together by use of a sealing tube.

The present invention is preferably made of a heavy-duty plastic material and is rust-free, durable and highly resistant to damage from road debris and rough handling. It will not nick or dent as easily as metal shields. It also can be stored on edge.

BRIEF DESCRIPTION OF DRAWINGS

FIG. 1 illustrates the present invention;

FIG. 2 is a cross-sectional view of the inventive manhole shield, taken along lines 2—2 in FIG. 1;

BEST MODE FOR CARRYING OUT THE INVENTION

The present invention is shown graphically and illustratively in FIG. 1. The invention comprises a one-piece shield 10 having an annular edge 12 at one end and another annular edge 14 at the other end. A series of annular grooves, wall areas and connecting shoulders and shapes (as explained below) are present between the two edges.

Preferably the shield is made of a heavy-duty thermoplastic material, such as high density polyethylene, although any equivalent material could be used so long as the object and advantages of the present invention are maintained. A material such as this is preferred since it provides a very durable, rust-free device which is highly resistant to damage from road debris and rough handling. The shields also can be stacked one on top of the other, or stored on edge, without damage.

The inventive shield 10 also is preferably made of a high-visibility yellow color. The color is molded in so the shield will not peel and if chipped will not need refinishing.

The shield 10 is made in any conventional manner, but preferably is blow molded or rotational molded.

Figure 3:
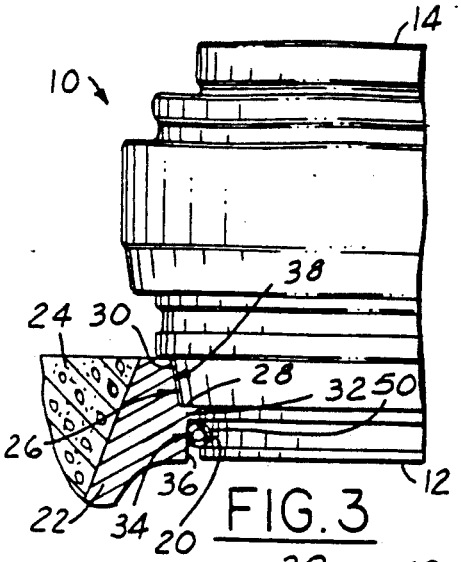
FIGS. 3–6 depict the use of the present invention in manhole openings of four different diameters.

The cross-sectional shape of the shield 10 is shown in FIG. 2 and the versatile use of the invention is shown in FIGS. 3-7. A first annular groove or channel 20 is positioned adjacent edge 12. Groove 20 has a first diameter $D_1$ which, as shown in FIG. 3, is dimensioned to fit a standard manhole opening frame 22 of a first size (preferably 27"). The manhole frame ring 22 is embeded in a street or other surface 24 and has an annular recessed groove 26 in which a heavy metal manhole cover (not shown) is normally situated to cover the manhole.

The recessed groove 26 has a horizontal surface 28 and a generally vertical surface 30 which is typically inclined outwardly from the manhole in order to allow easier installation and removal of the manhole cover.

The surface 28 forms the upper surface of a flange 32 which is part of a lip with an undercut shoulder 34. The shoulder has a relatively flat annular surface 36.

Immediately adjacent the first groove or channel 20 in the shield 10 is a first annular wall member 38 which is shaped to fit within the manhole cover recess. The wall member 38 has a generally horizontal portion 40 and an inclined surface 42 which generally has the same angle of inclination of surface 30 in recess 26. A second horizontal portion 44 is provided at the end of surface 42 opposite the portion 40. The wall member 38 has a diameter $D_2$ which is larger than the diameter $D_1$ of groove 20.

An inflatable elastic gasket 50 is positioned in groove 20 and is adapted to create a seal between the shield 10 and the shoulder 34 of flange 32. (The gasket 50 is shown in phantom lines in FIG. 2; as shown, gasket 50 is also adapted to be positioned in two other grooves 60 and 70 in shield 10 which will be explained further below.) The gasket 50 is preferably a heavy-duty rubber tube which can not be easily punctured or cut by sharp objects or debris which might be present in or around the manhole recess. An ordinary rubber bicycle inner tube provides one inexpensive gasket which can be utilized.

Once the gasket or tube 50 is installed in place, a hand pump (or even lung pressure) can be used to inflate it. An inflation stem or valve 52 on the tube 50 is positioned through an opening 54 in the channel 20 so that the valve can be reached easily and the tube 50 can be inflated from the hollow interior of the shield.

The sealing of the manhole ring 22 below the flange 32 and the seating of wall member 38 in the annular recess 26 provides a more positive seal and greater stability than known manhole shields. Once the gasket 50 is inflated, it acts to prevent the shield 10 from being removed from the manhole ring. In contrast, shields sealed by tubes in recess 26 can be popped out more readily. In fact, sometimes the inflation of the tube itself can "force" the shield in an upwardly direction due to the incline of surface 30 of the recess 26 making a stable seal difficult to obtain.

The seating of wall member 38 in the annular ring recess 26 makes the shield very stable in the opening and helps prevent it from being tipped if weight is applied only to one side. The position of the inflated gasket below the flange 32 also contributes to this stability.

A second groove or channel 60 is situated adjacent wall member 38. Connected to groove 60 is a second wall member 62 which comprises horizontal wall portion 64 and inclined vertical surface 66. Groove 60 has a third diameter $D_3$ which is greater than diameters $D_1$ and $D_2$. Wall member 62 has a fourth diameter $D_4$ which is larger than diameter $D_3$. An opening 68 is provided in groove 60 for insertion of valve or stem 52' of an inflatable gasket or tube 50'.

Figure 4:
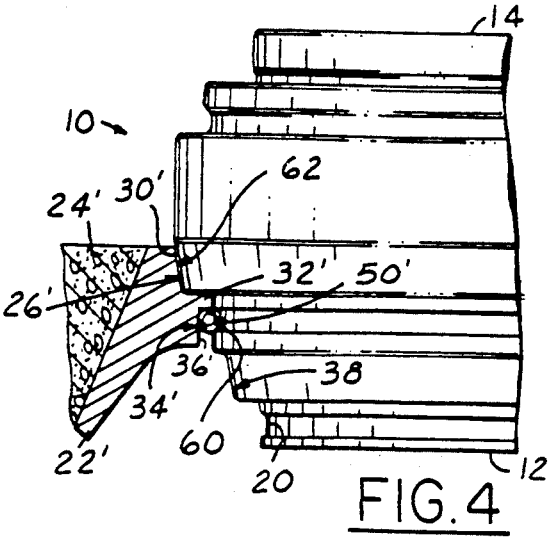

Groove 60 and wall member 62 are similar to groove 20 and wall member 38, respectively, and are provided for the same purpose and act in the same manner, except they are used with a larger manhole opening. This is shown in FIG. 4. With a larger manhole ring 22', the shield 10 fits deeper inside the manhole opening until the wall member 62 seats and nests in the recessed manhole cover groove 26'. Inflatable gasket 50' is installed in the groove or channel 60 (prior to insertion of the shield in the manhole opening) and is used to seal the opening under the flange 32'.

The groove 60 is dimensioned to fit a standard manhole opening frame 22' of a second size (preferably 30"). The shield 10 seats and seals this opening in precisely the same manner as explained above with respect to groove 20 and FIG. 3, and also provides the same benefits and advantages.

Figure 5:
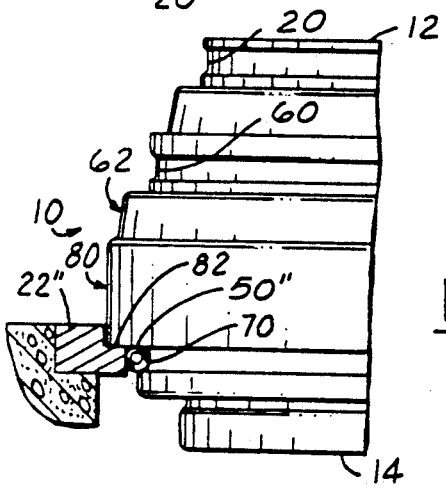

A third groove or channel 70 is also provided on shield 10 (closer to edge 14 than edge 12). Groove 70 is similar to grooves 20 and 60 and is provided for the same purpose. Groove 70, together with inflatable gasket or tube 50", seals a third size of standard manhole opening frame 22" (preferably 30¾"). This is shown in FIG. 5. In order to install the shield in this larger opening, the shield is reversed (i.e. rotated 180°) with annular edge 14 inserted into the manhole opening. Also, opening 72 is provided in groove 70 for insertion of valve 52" of the inflatable gasket.

A third wall member 80 is situated between groove 70 and the second wall member 62. Wall member 80 has a horizontal portion 82 and a generally vertical surface 84. Wall member 80 is adapted to seat and nest in the frame ring 22" of the manhole.

The third wall member 80 has a fifth diameter $D_5$ which is larger than any of diameters $D_1$-$D_4$. Groove 70 has a sixth diameter $D_6$ which is smaller than diameters $D_4$ and $D_5$, but larger than diameter $D_3$. The height H of wall member 80 (See FIG. 2) can be of any desired dimension, but preferably is approximately 3-6 inches in order to provide a sufficient barrier to prevent surface water and debris from being splashed or washed over the shield 10 and into the open manhole.

Adjacent edge 14 of shield 10 is an annular stacking groove or ring 90 which, unlike grooves 20, 60 and 70 is outwardly convex rather than outwardly concave. Ring 90 has a seventh diameter $D_7$ which is greater than diameter $D_1$ of groove 20, but less than any of diameters $D_2$-$D_6$. Preferably the diameter $D_7$ is just slightly greater than diameter $D_1$ so that the open end of one shield 10 along annular edge 14 will fit neatly over the open end of a second similar shield 10' along edge 12' when two shields are stacked together. This is shown in FIG. 7.

A fourth wall member 94 is situated adjacent groove 90 and positioned between groove 90 and groove 70.

Figure 7:
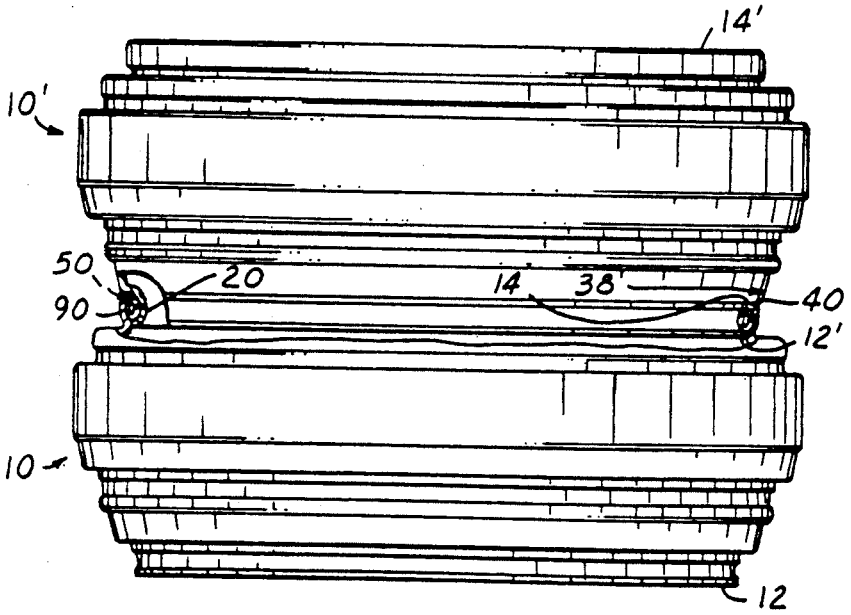
FIG. 7 illustrates the stackability of the present invention.

When it is desired to provide a higher barrier or shield to protect an open manhole, it is possible, as mentioned above, to stack two or more shields on top of one another in the manner shown in FIG. 7. If a seal between the two stacked shields is also desired, then a gasket or tube 50 can be positioned in the space between grooves 20 and 90 and inflated. The inflated gasket will hold the two shields firmly and securely together.

When two shields 10 and 10' are stacked together, annular edge 14 is adapted to abut and rest on wall portion 40 of wall member 38. This provides a solid and stable stacking structure.

If two or more shields are being stacked together simply for transportation or storage, they can be positioned together as indicated without the use of gaskets.

Since gasket or tube 50 is elastic, one size can be provided for use in all four grooves (20, 60, 70, 90). It should be provided of a size to fit snugly in the smallest groove (groove 20) and can be stretched to fit in the other grooves. It is also possible, however, to provide two or more gaskets or tubes with each shield 10, each sized to fit within one of the grooves.

Figure 6:
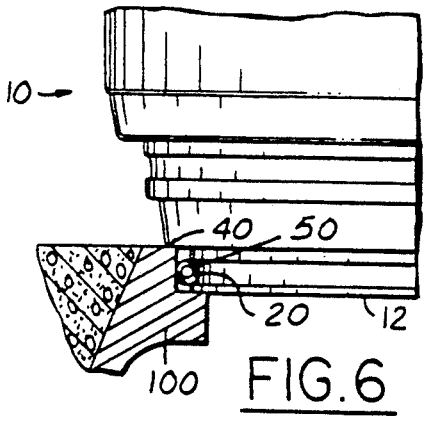

It is also possible to use the present invention to seal manhole openings of a fourth size. As shown in FIG. 6, where the manhole ring 100 has a diameter of approximately 26′ (which is less than the diameter of ring 22 in FIG. 3), then groove 20 can be used to seal the ring within the manhole cover recess in a conventional manner. Gasket or tube 50 is used in the same manner as indicated above to provide the water seal. Wall portion 40 is adapted to rest on the top of frame ring 100 providing a stable base.

As shown, the present inventive shield is very versatile as it can be used to seal manhole openings of four different diameters (ranging from 26″ to 30¾″). By gripping and sealing the manhole frame rings underneath or below a flange, the shield provides an improved and more stable sealing structure. The "deep-seated" design provides a more positive seal and greater stability. The shield cannot be popped out (unseated) as easily as conventional shields. Also, a series of wall members act to position and stabilize the shield in each of the four differently sized openings.

Although particular emodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

What is claimed is:

1. A shield device for protecting and sealing a utility opening having an annular radially extending ridge therein, said shield comprising:

a hollow cylindrical body member having a first annular edge at one end;

a first annular channel portion in said body member adjacent said first edge, said first edge and said first channel being dimensioned to fit within said annular ridge of said opening;

a radially outwardly extending annular wall member adjacent said first channel and positioned substantially perpendicular thereto, said wall member positioned to rest on said annular ridge;

whereby a sealing member positioned in said channel provides a seal between said shield and the under side of said ridge, and also assists in holding said shield in said manhole opening.

2. The shield as set forth in claim 1 further comprising a sealing member positioned in said channel.

3. The shield as set forth in claim 2 wherein said sealing member is inflatable.

4. The shield as set forth in claim 1 further comprising an angled wall member attached to said annular wall member and extending substantially in the direction of the longitudinal axis of said shield.

5. The shield as set forth in claim 4 further comprising a second annular wall member attached to said angled wall member, said second annular wall member extending radially outwardly.

6. The shield as set forth 5 further comprising a second annular channel portion adjacent said second annular wall member, said second annular channel portion having a diameter greater than said first annular channel portion.

7. The shield as set forth in claim 6 further comprising a third annular wall member positioned adjacent said second annular channel and being substantially perpendicular thereto, said third annular wall member extending radially outwardly.

8. The shield s set forth in claim 7 further comprising a sealing member for being selectively positioned in either said first or second annular channel portions.

9. A combination utility opening member and protective removable shield, said utility opening member having a first recessed annular ledge for retaining a cover member therein and an annular radially inwardly extending ridge adjacent said ledge, said shield comprising a hollow generally cylindrical body with a first annular edge at one end, a first annular channel portion adjacent said first edge, said first edge and first channel portion positioned within said annular ridge of said opening member, a generally radially outwardly extending annular wall member adjacent said first channel portion and resting on said recessed ledge, and a sealing member positioned in said first channel portion for providing a seal between said shield and said ridge.

10. The invention as set forth in claim 9 wherein said sealing member is inflatable.

11. The invention as set forth in claim 9 further comprising an angled wall member attached to said outwardly extending annular wall member and extending substantially in the direction of the longitudinal axis of said shield.

12. The invention as set forth in claim 11 further comprising a second annular wall member attached to said angled wall member, said second annular wall member extending radially outwardly.

13. The invention as set forth in claim 12 further comprising a second annular channel portion adjacent said second annular wall member, said second annular channel portion having a diameter greater than said first annular channel portion.

14. The invention as set forth in claim 13 further comprising a third annular wall member positioned adjacent said second annular channel and being substantially perpendicular thereto, said third annular wall member extending radially outwardly.

15. A shield for protecting and sealing a utility access opening, said shield comprising:

a hollow generally cylindrical body having a first annular edge at one end, a second annular edge at the other end and an axial extending longitudinal axis;

a first annular concave channel in said body adjacent said first edge;

a first wall member adjacent said first channel, said first wall member having a first portion extending radially outwardly relative to said longitudinal axis and a second portion extending at an angle substantially in the direction of said longitudinal axis;

whereby a sealing member positioned in said channel provides a seal with said utility access opening.

16. The shield as set forth in claim 15 further comprising a sealing member positioned in said first channel.

17. The shield as set forth in claim 16 wherein said sealing member is inflatable and said channel has an opening therein for use in inflating said sealing member.

18. The shield as set forth in claim 15 further comprising a second annular concave channel in said body.

19. The shield as set forth in claim 18 wherein said second annular concave channel has a diameter greater than said first channel.

20. The shield as set forth in claim 15 further comprising an annular convex channel in said body adjacent said second edge, said convex channel having a diameter greater that the diameter of said first annular concave channel, whereby when two or more shields are stacked longitudinally one on top of the other, said first edge and first concave channel will fit within said second edge, and said convex channel and said first concave channel will nest together forming an annular space.

21. The shield as set forth in claim 20 further comprising a sealing member for positioning in said annular space.

22. A shield for protecting and sealing a utility access opening and being able to be stacked with a second shield of the same kind, said shield comprising:

a hollow generally cylindrical body having a first annular edge at one end, a second annular edge at the other end and an axial extending longitudinal axis;

a first annular concave channel in said body adjacent said first edge;

a first wall member adjacent said first channel and having a portion extending radially outwardly relative to said longitudinal axis;

an annular convex channel in said body adjacent said second edge;

said second edge and convex channel having diameters greater than said first edge and first concave channel;

whereby when two of said shields are stacked longitudinally one on top of the other, said first edge and first concave channel of a first shield are nested within said second edge and convex channel of a second shield, and an annular space is formed between said convex channel and said first concave channel.

23. The shield as set forth in claim 22 further comprising a sealing member in said annular space.

24. The shield as set forth in claim 23 wherein said sealing member is inflatable and said first concave channel has an opening therein for use in inflating said sealing member.

25. The shield as set forth in claim 23 further comprising a second annular concave channel in said body adjacent said first wall member, said second concave channel having a diameter greater than the diameter of said first concave channel.

26. The shield as set forth in claim 25 further comprising a second wall member extending radially outwardly relative to said longitudinal axis, said second wall member positioned adjacent said convex channel.

27. The shield as set forth in claim 26 further comprising a third annular concave channel, said third concave channel positioned in said body adjacent said second wall member and having a diameter greater than the diameter of said second concave channel.

28. The shield as set forth in claim 27 wherein each of said first, second and third concave channels have openings therein for use in inflation of a sealing member positioned in said channels.

29. The shield as set forth in claim 27 further comprising a flexible sealing member selectively positioned in either said first, second or third concave channels.

30. The shield as set forth in claim 29 wherein said sealing member is inflatable and each of said first, second and third concave channels have openings therein for use in inflating said sealing member.

31. A shield for protecting and sealing utility access openings of various diameters, said shield comprising:

a hollow generally cylindrical body having a first annular edge at one end, a second annular edge at the other end and an axial extending longitudinal axis;

a first annular concave channel in said body adjacent said first edge;

a first wall member adjacent said first channel, said first wall member having a first portion extending radially outwardly relative to said longitudinal axis and a second portion extending at an angle substantially in the direction of said longitudinal axis;

a second annular concave channel in said body adjacent said first wall portion, said second concave channel having a diameter greater than the diameter of the first concave channel;

a second wall member adjacent said second channel; and a third annular concave channel in said body positioned near said second annular edge, said third annular channel having a diameter greater than the diameter of said second annular channel and accessible for use upon a 180° revolution of said body relative to said longitudinal axis.

32. The shield as set forth in claim 31 further comprising a sealing member positioned in either said first, second or third channels.

33. The shield as set forth in claim 32 wherein said sealing member is inflatable and said first, second and third channels have openings therein for inflation of said sealing member.

34. The shield as set forth in claim 31 further comprising an annular stacking groove positioned immediately adjacent said second edge between said edge and said third annular concave channel, said stacking groove having a diameter greater than the diameter of said first annular concave channel.

35. The shield as set forth in claim 34 further comprising a shoulder portion positioned between said stacking groove and said third annular channel, said shoulder portion extending radially outwardly relative to said longitudinal axis.

36. The shield as set forth in claim 31 wherein said second wall member has a first portion extending radially outwardly relative to said longitudinal axis and a second portion extending substantially in the direction of said longitudinal axis and separating said second concave channel from said third concave channel.

* * * * *

UNITED STATES PATENT AND TRADEMARK OFFICE

CERTIFICATE OF CORRECTION

PATENT NO. : 5,046,886

DATED : September 10, 1991

INVENTOR(S) : David J. Muir et al.

It is certified that error appears in the above-identified patent and that said Letters Patent is hereby corrected as shown below:

Column 2, line 24; before "be" insert --to--.

Column 5, line 35; "emodiments" should be --embodiments--.

Column 6, line 5; after "forth" insert --in claim--.

Column 6, line 15; after "shield" delete "s" and insert --as--.

Signed and Sealed this

Twenty-third Day of February, 1993

*Attest:*

STEPHEN G. KUNIN

*Attesting Officer*

*Acting Commissioner of Patents and Trademarks*